United States Patent [19]

Buschmann

[11] 4,046,353

[45] Sept. 6, 1977

[54] FENCE WIRE STRETCHING DEVICE

[76] Inventor: Sylvester Buschmann, Maries Valley View, Vienna, Mo. 65582

[21] Appl. No.: 735,383

[22] Filed: Oct. 26, 1976

[51] Int. Cl.[2] ..... B66F 19/00

[52] U.S. Cl. ..... 254/83; 24/132 R

[58] Field of Search ..... 254/83, 77; 24/132 WF, 24/132 WA

[56] References Cited

U.S. PATENT DOCUMENTS

| | | | |
|---|---|---|---|
| 1,911,274 | 5/1933 | Handley | 254/83 |
| 3,881,690 | 5/1975 | Combs | 254/83 |

*Primary Examiner*—Robert C. Watson

*Attorney, Agent, or Firm*—Lowe, Kokjer, Kircher, Wharton & Bowman

[57] ABSTRACT

A device for stretching fence wire tightly between fence posts. A flat base plate has outwardly projecting L-shaped fingers which present end portions that are spaced from and parallel to the plate surface. A round camming bar is provided with partial circumferential grooves which are eccentric with respect to the bar axis. The fence wire is placed on the base plate, and the bar is placed on the wire with the grooves registering with the fingers. Turning of the bar causes camming action between the fingers and eccentric grooves in order to press the bar tightly against the base plate with the fence wire clamped tightly therebetween.

8 Claims, 4 Drawing Figures

24
16
22
23
16
16
2.
16
23
22
16
14
13
10
16
18a
19
18
19
18a
2.
12
11
12

14
16
16c
20
13
11

4.
16b
16
16a
11
13
4.
16c
14
20
23
22
19
18

24
22
16b
16
16a
11
13
23
16c
14
20
19
18

FENCE WIRE STRETCHING DEVICE

BACKGROUND AND SUMMARY OF THE INVENTION

This invention relates generally to the construction of wire fences and more specifically to an improved clamp device for use in stretching fence wire between fence posts.

Typically, existing fence wire stretchers employ a cam member which acts against lug elements projecting from a base plate in order to clamp the wire in place. Such devices have not enjoyed substantial acceptance or success, primarily because the cam members are unduly complex and costly. For example, the camming bar shown in the Combs U.S. Pat. No. 3,881,690 comprises essentially a round bar which has been cut longitudinally in half and welded back together with the halves offset somewhat to achieve a cam configuration. Manifestly, the difficulty involved in fabricating this type of camming bar leads to a high production cost.

Another type of wire stretcher is shown in the Handley U.S. Pat. No. 1,911,274 in which cylindrical clamping sections are arranged eccentrically on a bar in order to produce a camming effect when the bar is turned. Again, the fabrication cost is high due to the difficulty of forming the clamping sections eccentrically on the bar. In addition, since large spaces are presented between the clamping sections, the bar is able to slide axially on the base and thus possibly work loose as it is being used. Accordingly, the device is highly susceptible to slipping along the fence wire as the fence is being strung.

It is an important object of the present invention to provide an improved wire stretching device which may be quickly and easily applied to the fence wire and removed therefrom.

Another object of the invention is to provide a wire stretching device which is able to firmly clamp the fence wire without inadvertently loosening or slipping thereon. In this respect, it is an important feature of the invention that the fingers are able to fit closely in the eccentric grooves so as to prevent the camming bar from possibly slipping along the base plate and thereby working itself loose from the wire.

A further object of the invention is to provide a wire stretching device which is constructed more simply and economically than existing devices.

An additional object of the invention is to provide a wire stretching device in which the pulling force applied by a towing vehicle tends to increase the firmness with which the wire is held.

Still another object of the invention is to provide a wire stretching device which includes an improved guide bar arrangement to prevent twisting and other misalignment.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
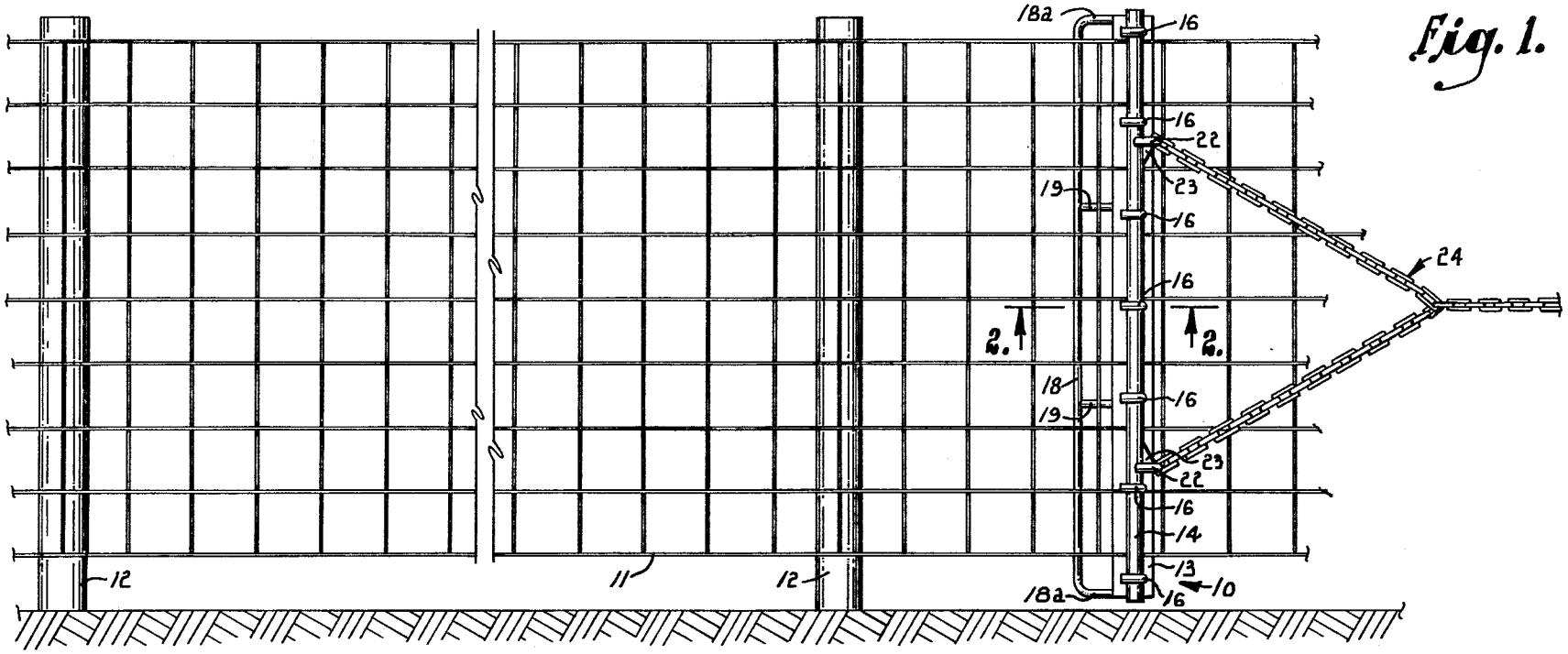
FIG. 1 is an elevational view illustrating the wire stretching device of the present invention employed to stretch fence wire between posts.

Referring now to the drawing in detail and initially to FIG. 1, the fence wire stretching device of the present invention is generally designated by reference numeral 10. The device serves to tightly stretch a length of fence wire 11 between fence posts 12 to which the wire is to be attached. The device 10 is constructed in two separate parts, a base plate 13 and a camming bar 14.

Figure 4:
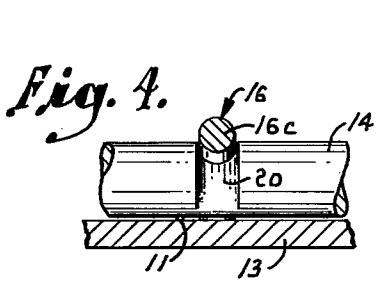
FIG. 4 is a cross sectional view taken generally along line 4—4 of FIG. 3 in the direction of the arrows.

The base 13 is a flat, rectangular plate which has a plurality of generally L-shaped lugs or fingers 16 projecting from its flat upper surface. The fingers 16 are spaced equidistantly from one another along the length of plate 13. With additional reference to FIGS. 2 and 3, each finger 16 is a curved member which includes a shank **16*a* that is welded to the upper surface of plate 13 to project therefrom at a right angle. An intermediate portion 16*b* of the finger gradually curves through 90° from shank 16*a* and joins an outer end portion 16*c* which is spaced outwardly from and parallel to the upper surface of plate 13. Fingers 16 are each circular in cross section, as best shown in FIG. 4, and portions 16*c*** are thus cylindrical.

A guide bar 18 serves to prevent the device from twisting or otherwise becoming misaligned with respect to the fence wire. Bar 18 is parallel with the side edge of plate 13 and is spaced outwardly therefrom. The bar has a pair of integral end legs **18*a* (FIG. 1) which extend from its opposite ends along the underside of plate 13. The legs 18*a* are each welded to the surface of plate 13 in order to attach the guide bar 18 thereto. Intermediate brace rods 19 which are parallel to legs 18*a* are welded to bar 18 and to the underside of plate 13 in order to strengthen the connection between the bar and plate. Since the legs 18*a* and the braces 19 extend along a flat surface of plate 13 which is opposite the surface from which fingers 16** project, there is a large surface area of the plate to which the legs and braces are securely welded, while interference with the function of the fingers is avoided.

Figure 3:
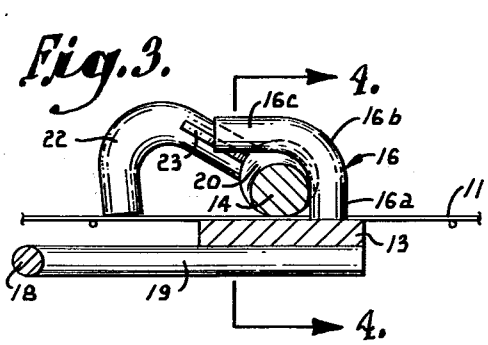
FIG. 3 is a cross sectional view similar to FIG. 2, but with the device in position to release the fence wire.
Figure 2:
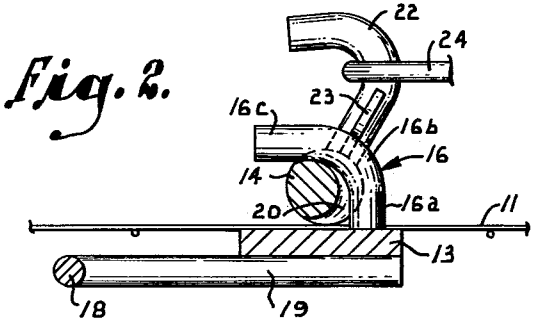
FIG. 2 is a cross sectional view on an enlarged scale taken generally along line 2—2 of FIG. 1 in the direction of the arrows, with the device in position to tightly clamp the fence wire.

The camming bar 14 is an elongate cylindrical bar section in which a plurality of eccentric grooves 20 are formed. As best illustrated in FIGS. 2 and 3, each groove 20 extends only partially around the circumference of the bar. Preferably, the grooves extend through an arc no greater than about 270°. As previously suggested, each groove 20 is eccentric with respect to the longitudinal axis of bar 14. The grooves 20 are spaced uniformly apart from one another along the length of the bar to correspond with spacing between fingers 16, and the grooves are sized to closely receive the respective fingers. As best shown in FIG. 4, the bottom area and the lower side portions of the grooves are smoothly rounded in order to correspond with the curved shape of the finger end portions **16*c*. The width of each groove 20, or its dimension in the direction of the axis of bar 14, is substantially equal to the diameter of the finger end portion 16*c*. Accordingly, the fingers are able to closely fit in the grooves, and bar 14 is unable to slide axially along base 13 due to the engagement between fingers 16 and the side walls of grooves 20. As shown in FIGS. 2 and 3, the distance between base 13 and the finger end portions 16***c* is somewhat less than the normal diameter of bar 14 and somewhat greater than the bar diameter within grooves 20. There are preferably seven fingers and seven grooves (see FIG. 1) in order to provide firm clamping of the fence wire 11 along the entire length of bar 14.

A pair of hooks 22 are welded to project outwardly from bar 14 at locations spaced on opposite sides of its center. Triangular gussets 23 reinforce the connection of hooks 22 to the bar. The hooks 22 are curved and are able to receive a towing chain 24 which is in a V-shape and which may be attached to a towing vehicle such as a tractor (not shown).

In use, the device 10 assists in tightly stretching the fence wire 11 between posts 12. With bar 14 separated from base 13, the fence wire is received on the flat surface of the base plate as shown in FIG. 3. The bar 14 is then inserted on top of the fence wire with the long eccentrics of grooves 20 oriented toward finger portions 16*c* so that the grooves are able to register loosely with the fingers.

To clamp the fence wire 11 tightly between base 13 and bar 14, the bar is rotated about its axis in a clockwise direction as viewed in FIG. 3. The hooks 22 provide handles which facilitate turning of the bar. As bar 14 rotates to turn the eccentric grooves 20 relative to fingers 16, the round outer surface of the bar rolls against plate 13 (and wire 11), while the portions of the bar within grooves 20 cam against the finger end portions 16c due to the eccentricity of the grooves. As a result, when the bar has been rotated approximately 90° to the clamping position shown in FIG. 2, it is tightly wedged between plate 13 and the finger end portions 16*c,* thereby firmly clamping the fence wire between bar 14 and plate 13.

With the device oriented vertically as shown in FIG. 1, the towing chain 24 is attached to hooks 22 and to the towing vehicle, and the vehicle is then driven forwardly to string the fence wire 11 between the fence posts 12. The towing force exerted on hooks 22 urges the hooks clockwise as viewed in FIG. 2 in order to more firmly retain bar 14 in its clamping position during stretching of the wire. The guide bar 18 engages the fence wire to prevent twisting or other misalignment of the device.

The device may be quickly and easily released from wire 11 for movement to a different location thereon by rotating bar 14 counterclockwise from the clamping position of FIG. 2 to the release position of FIG. 3. The long eccentrics of grooves 20 are rotated toward finger portions 16*c,* and bar 14 is thus moved out of engagement with portions 16*c.* In the release position, the bar may be easily separated from plate 13, and the device may be moved to a new position on the fence wire.

It is again noted that the close fit of fingers 16 in grooves 20 absolutely prevents bar 14 from sliding axially relative to plate 13. In the clamping position (FIG. 2) the long eccentrics of grooves 20 are offset only 90° from the release position (FIG. 3), and portions 16c of the fingers therefore remain in relatively deep areas of the grooves such that they are firmly retained therein. Consequently, when strong forces are applied to the device as when it is being pulled by the towing vehicle (not shown), the camming bar and base plate cannot inadvertently shift in position to possibly work loose and slip on the wire.

Since standard round bar stock may be used to construct bar 14, the fabrication cost of the bar is reduced in comparison to existing devices. The relatively small grooves 20 are easily formed as compared to making the bar eccentric along its entire length or a substantial portion thereof, as is typically done in the prior art. Also, the grooves extend only partially around bar 14 and they are thus formed more easily and with less waste of material than would be the case if they were to extend completely around the bar. The narrow width of the grooves is also significant in regard to ease of formation and conservation of material.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention I claim:

1. In a device for use in stretching fence wire, the improvement comprising:

a base presenting a substantially flat surface for receiving the fence wire;

a plurality of spaced fingers projecting from said base, said fingers each having an end portion spaced outwardly of said flat surface and generally parallel thereto;

a substantially round bar member adapted for insertion between said base and the end portions of said fingers with the fence wire located between said bar member and base; and means presenting a plurality of spaced grooves in said bar member extending in a generally circumferential direction therein and arranged eccentrically with respect to the longitudinal axis thereof, said grooves extending only partially around said bar member, said grooves being located to register with the respective fingers and being sized to closely receive same, whereby rotation of said bar member effects camming action of said fingers within said grooves to press said bar member tightly against said base with the fence wire clamped therebetween.

2. The improvement set forth in claim 1, wherein the dimension of each groove in the direction of the longitudinal axis of said bar member is substantially equal to the corresponding dimension of each finger to thereby establish a close fit of said fingers in the respective grooves.

3. The improvement set forth in claim 2, wherein said end portions of the fingers are each substantially cylindrical in shape and said grooves are each rounded in shape to substantially conform in shape to said end portions to receive said end portions in a close fit therewith.

4. The improvement set forth in claim 1, wherein each of said grooves extends around said bar member through an arc no greater than approximately 270°.

5. The improvement set forth in claim 1, wherein each groove has a long eccentric and said bar member has a release position wherein the fence wire is released from between said bar member and base and wherein said long eccentrics are oriented generally toward said end portions of the respective fingers, said bar member having a clamping position wherein the fence wire is tightly clamped between said bar member and base and wherein said long eccentrics are rotated approximately 90° from the release position.

6. The improvement set forth in claim 1, wherein each finger includes a shank extending substantially at a right angle from said flat surface of the base and a curved intermediate portion connecting the end portion with said shank.

7. The improvement set forth in claim 1, including a guide bar for engagement with the fence wire to resist twisting of said base relative thereto, and a plurality of connection elements connecting said guide bar with said base a spaced distance therefrom, said connection elements being secured to a second substantially flat surface of said base opposite the first mentioned flat surface thereof.

8. The improvement set forth in claim 1, wherein said end portions of the fingers are each substantially cylindrical in shape and said grooves are each rounded in shape to substantially conform in shape to said end portions to receive said end portions in a close fit therewith.

* * * * *